United States Patent [19]

Honma

[11] 4,399,857

[45] Aug. 23, 1983

[54] ROLLER ASSEMBLY FITTING DEVICE FOR USE IN A ROLLER BLIND

[75] Inventor: Kazuo Honma, Tokyo, Japan

[73] Assignee: TOSO Kabushiki Kaisha, Tokyo, Japan

[21] Appl. No.: 291,950

[22] Filed: Aug. 11, 1981

[30] Foreign Application Priority Data

Aug. 29, 1980 [JP] Japan ..... 55-121909

[51] Int. Cl.[3] ..... A47H 1/13

[52] U.S. Cl. ..... 160/323 R; 160/326

[58] Field of Search ..... 160/323 R, 324, 325, 160/326, 319

[56] References Cited

U.S. PATENT DOCUMENTS

| | | | |
|---|---|---|---|
| 1,882,592 | 10/1932 | Hendrickson | 160/326 |
| 1,920,099 | 7/1933 | Moricca | 160/326 X |
| 2,307,095 | 1/1943 | Zaferakis | 160/326 |

*Primary Examiner*—Peter M. Caun
*Assistant Examiner*—Cherney S. Lieberman
*Attorney, Agent, or Firm*—Birch, Stewart, Kolasch & Birch

[57] ABSTRACT

A roller assembly fitting device for selectively locking the retraction of the pivot, which is inserted in a bore in a mounting bracket to support the roller assembly in both brackets. The device has a roller-end sleeve fixed to the roller assembly, a guide sleeve rotatably mounted in the roller-end sleeve, a pivot retractably mounted in the guide sleeve, and a coil spring interposed between the guide sleeve and the pivot to bias them in opposite directions. The guide sleeve has its radial projection for selectively fitting engagement with axial and peripheral grooves formed in the outer periphery of the pivot. The pivot is retractable when the guide sleeve is in the first position in which the projection is in the axial groove but locked when the guide sleeve is in the second position in which the projection is in the peripheral groove.

5 Claims, 4 Drawing Figures

ROLLER ASSEMBLY FITTING DEVICE FOR USE IN A ROLLER BLIND

BACKGROUND AND SUMMARY OF THE INVENTION

The present invention relates to a roller assembly fitting device for use in a roller blind of the type having a retractable pivot to set up the roller assembly in a mounting bracket.

The roller blind has a roller assembly supported by a pair of mounting brackets, the assembly including a hollow roller, a screen wound on the hollow roller, and a fitting device disposed at one end of the hollow roller. The device comprises an end sleeve removably secured to the hollow roller, a pivot retractably mounted in the sleeve, and a coil spring mounted in the sleeve to extrude the forward end portion of the pivot out of the sleeve into a bore in the bracket. The roller assembly is supported by the brackets, when the pivot has the forward end portion thereof inserted in the bracket by the coil spring which is not contracted. On the other hand, the roller assembly is passable between the opposite brackets while the coil spring is contracted to retract the pivot from the bracket.

The known device has no provision for locking the axial movement of the pivot, therefore permitting the pivot to retract when a thrust acts against the coil spring. Such a thrust sometimes occurs in the case where the roller blind is roughly operated or shaken by wind. This leads to an accident where the roller assembly suddenly drops down from the bracket to damage persons and articles under the blind.

It is the primary object of the invention to provide a roller assembly fitting device for use in a roller blind in which a pivot is selectively locked after the roller assembly is set up in the permanent position, thereby preventing the roller assembly from falling down.

To this end, a roller assembly fitting device in accordance with the invention includes a roller-end sleeve removably secured to a hollow roller on which a screen is wound, a guide sleeve coaxially mounted in the roller-end sleeve, the guide sleeve being rotatable between first and second angular positions in the roller-end sleeve, a pivot passing through the respective center bores in the roller-end and guide sleeves and being formed on the periphery with an annular step, axial and peripheral grooves, and a coil spring interposed between the bottom of the guide sleeve and the step of the pivot to bias them in the opposite directions. The guide sleeve has an inner radial projection for selective fitting engagement with the axial and peripheral grooves. The inner radial projection is in the axial groove to permit the axial movement of the pivot when the guide sleeve is in the first angular position and shifts in the peripheral groove to lock the axial movement of the pivot when the guide sleeve rotates to the second angular position.

The guide sleeve has a flange in the form of a handle pressed to a flange portion of the roller-end sleeve, the guide and roller-end flanges having their axial recess and projection coupled with each other. The recess is so cambered to put the projection either in one side of the recess in which the guide sleeve is in the first angular position or in the other side in which the guide sleeve is in the second angular position. The device has a stopper integrally formed in the pivot. The stopper is hook-shaped so as to be erected from the rear end portion of the pivot for abutting engagement with the bottom of the roller-end sleeve, thereby preventing the excessive extrusion of the pivot.

The advantages offered by the invention are mainly that the roller assembly never drops down even if the roller blind is roughly operated or shaken by wind. Damage to persons, articles, and the roller assembly itself is avoided. All in all, there is no danger under the blind.

BRIEF DESCRIPTION OF THE DRAWINGS

One way of carrying out the invention is described in detail below with reference to drawings which illustrate only one specific embodiment, in which.

DETAILED DESCRIPTION OF THE INVENTION

Figure 1:
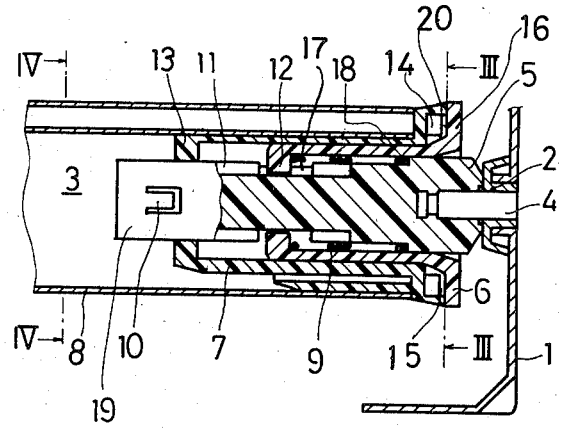
FIG. 1 is a sectional view of the relevant portion of the roller blind provided with the device of the invention.

The figures show a roller assembly fitting device mounted in a roller assembly 3 including a hollow roller 8 on which a non-illustrated screen is wound. The device comprises a roller-end sleeve 7 of plastic removably secured to the hollow roller 8, a guide sleeve 6 of plastic coaxially mounted in the roller-end sleeve 7 and a pivot 5 of plastic coaxially mounted in the guide sleeve 6. The pivot 5 has a metal pin 4 fixed to the forward end for fitting engagement with a bore portion 2 in a mounting bracket 1. The pivot 5 has in the forward portion thereof an annular step 18 to define an annular space of reduced diameter in the guide sleeve 6, in which a coil spring 9 is contained. The coil spring 9 is interposed between the step 18 and the bottom of the guide sleeve 6 to bias the pivot 5 and the guide sleeve 6 in the opposite directions. The pivot 5 has the rear end portion 19 hollowed and integrally formed with a hook-shaped stopper 10. The stopper 10 erects as it is rearwardly pushed. Thus, the stopper 10 permits the rear end portion of the pivot 5 to pass through the center bore in the roller-end sleeve 7 but prevents the same from slipping out of the center bore, therefore keeping the extrusion of the pin 4 within a limit.

Figure 2:
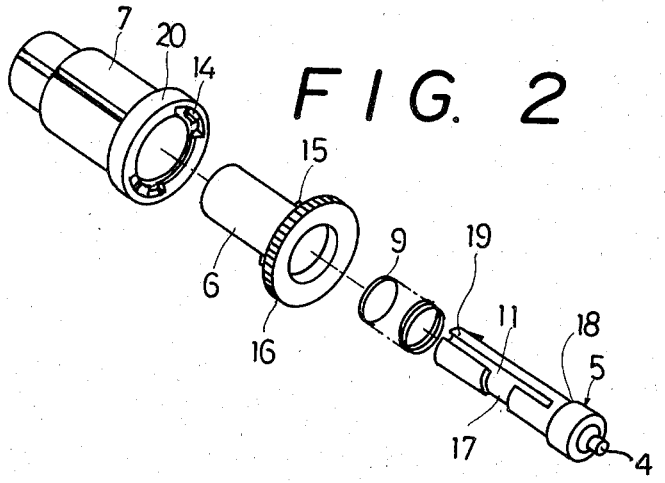
FIG. 2 is an exploded perspective view of the parts of the device of FIG. 1.
Figure 3:
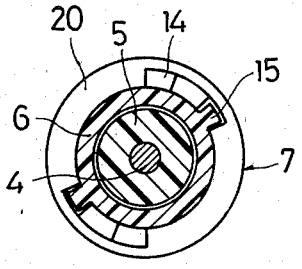
FIGS. 3 and 4 are sectional views along lines III—III and IV—IV in FIG. 1.
Figure 4:
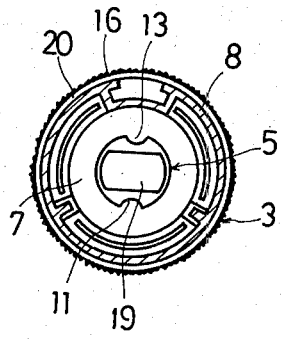

The pivot 5 has in the periphery thereof a pair of axial grooves 11 extending from the step 18 to the rear end and a peripheral groove 17 perpendicularly crossing the axial groove 11, as best seen in FIG. 2. The roller-end sleeve 7 has in the center bore thereof a pair of radial inner projections 13 fitted in the axial grooves 11, as best seen in FIG. 4. As seen in FIG. 1, the guide sleeve 6 has in the center bore of the bottom a pair of inner radial projections 12 fitted in the crossing of the axial and peripheral grooves 11, 17 when the stopper 10 abuts the bottom of the roller-end sleeve 7. The guide sleeve 6 is rotatably mounted in the roller-end sleeve 7 and includes a handle-shaped flange 16 pressed to a flange portion 20 by the coil spring 9. The flange 16 is thin and rugged so as to be easily operated by one's finger and has a pair of angular axial projections 15 fitted in the respective sectorial recesses 14 in the flange portion 20, as best seen in FIG. 4. The sectorial recess 14 is wider than the angular projection 15 and cambered so that the projection 15 is caused to rest in either of the opposite sides of the recess 14 when the guide sleeve 6 is resiliently biased to the roller-end sleeve 7. The projection 13 is always in the axial groove 11 without preventing the axial movement of the pivot 5. The guide sleeve 6 is rotatable between first and second angular positions in the roller-end sleeve 7 in which the axial projection 15 is in one and the other sides of the recess 14. The radial projection 12 is in the axial groove 11 to permit the retraction of the pivot 5 when the guide sleeve 6 is in the first angular position. On the other hand, the projection 12 is deep in the peripheral groove 17 to prevent the pivot 5 from retracting when the guide sleeve 6 locates in the second angular position. The radial projection is rotatable along and to the peripheral groove 17 from the axial groove 11 unless the pivot 5 retracts. The roller assembly 3 has a fixed pivot at the other non-illustrated end.

As a preliminary step to mount the roller assembly 3 in the bracket 1, the handle flange 16 is rotated to set the guide sleeve 6 in the first angular position. The pin 4 as well as the pivot 5 is retractable for a time to pass between the opposite brackets 1, so that the pin 4 is easily fitted in the bore portion 2. The coil spring 9 presses the pin 4 into the bore 2 until the stopper 10 abuts the bottom of the roller-end sleeve 7 to prohibit excessive insertion of the pin 4. Thereafter, either the flange 16 or the hollow shaft 8 is inversely rotated to set the guide sleeve 6 in the second angular position in which the radial projection 12 situates in the peripheral groove 17 to prevent any axial movement of the pivot 5. In order to shift the guide sleeve 6 between the both angular positions, a somewhat helical torsion is needed to cause the axial projection 15 to get over a cambered portion between the opposite sides in the same recess 14. Such a torsion is easily transmitted by one's finger operation but not easily transmitted in the case when the blind is roughly handled or shaken by wind. Therefore, once the roller assembly 3 is set up in the permanent position and the flange 16 turned to lock the pivot 5, it will never drop from the bracket 1 even if the screen is roughly operated or shaken by wind.

What is claimed is:

1. A roller assembly fitting device for use in a roller having a roller assembly supported by a pair of mounting brackets and provided with a hollow roller on which a screen is wound, said device comprising a roller-end sleeve removably secured to the hollow roller, a guide sleeve coaxially mounted in said roller-end sleeve, said guide sleeve being rotatable between first and second angular positions in said roller-end sleeve, a pivot retractably mounted in said sleeves, said pivot passing through the respective bores in said roller-end and guide sleeves and having in the outer periphery thereof an annular step and axial and peripheral grooves, a coil spring interposed between said step and the bottom of said guide sleeve to bias them in opposite directions, said roller-end sleeve having an inner radial projection fitted in said axial groove for rotation with said pivot, said guide sleeve having an inner radial projection for selectively fitting engagement with said axial and peripheral grooves, whereby the radial projection of said guide sleeve locates in said axial groove to permit the retraction of the pivot when said guide sleeve is in the first angular position but enters said peripheral groove to lock the retraction of the pivot when said guide sleeve shifts to the second angular position.

2. A roller assembly fitting device as claimed in claim 1, wherein said guide sleeve is formed with a handle flange pressed to a flange portion of said roller-end sleeve by said coil spring, said guide and roller-end sleeves having an axial projection and a recess coupled with each other, said recess being cambered to put said projection either in one side of said recess in which said guide sleeve is in the first angular position or in the other side in which said guide sleeve is in the second angular position.

3. A roller assembly fitting device as claimed in claim 2, wherein said flange of said guide sleeve is thin and rugged to be easily operated.

4. A roller assembly fitting device as claimed in claim 2, wherein said pivot has a metal pin fixedly attached to the forward end thereof for fitting engagement with a bore portion in said mounting bracket.

5. A roller assembly fitting device as claimed in claim 2, wherein said pivot is integrally formed at the rear end portion thereof with a hook-shaped stopper, said stopper being erectable to abut the bottom of said roller-end sleeve when it is pushed away from an adjacent mounting bracket.

* * * * *